US006758800B2

(12) United States Patent
Boix Jaen

(10) Patent No.: US 6,758,800 B2
(45) Date of Patent: Jul. 6, 2004

(54) MACHINE FOR ASSEMBLING CARDBOARD BOXES

(75) Inventor: José Boix Jaen, Albatera (ES)

(73) Assignee: Boix Maquinaria, S.A., Albatera (ES)

( * ) Notice: Subject to any disclaimer, the term of this patent is extended or adjusted under 35 U.S.C. 154(b) by 0 days.

(21) Appl. No.: 10/434,969

(22) Filed: May 9, 2003

(65) Prior Publication Data

US 2004/0023768 A1 Feb. 5, 2004

Related U.S. Application Data

(63) Continuation of application No. PCT/ES02/00391, filed on Aug. 2, 2002.

(30) Foreign Application Priority Data

Aug. 3, 2001 (ES) ..... 200101835

(51) Int. Cl.[7] ..... B31B 1/44

(52) U.S. Cl. ..... 493/167; 493/84; 493/120; 493/122; 493/123; 493/124; 493/125; 493/141; 493/143; 493/170

(58) Field of Search ..... 53/52, 58, 60, 53/84, 89, 120, 122, 123, 124, 125, 126, 140, 141, 142, 143, 144, 167, 170

(56) References Cited

U.S. PATENT DOCUMENTS 2,962,944 A 12/1960 Neely
3,650,183 A 3/1972 Striplin
3,673,928 A 7/1972 Striplin
3,780,627 A * 12/1973 Roda ..... 493/91
4,023,471 A * 5/1977 Royal ..... 493/114

FOREIGN PATENT DOCUMENTS

| | | |
|---|---|---|
| ES | 358976 | 7/1970 |
| ES | 8701604 | 3/1987 |
| ES | 2 012 928 | 4/1990 |
| ES | 2 081 235 | 2/1996 |

* cited by examiner

*Primary Examiner*—Eugene Kim
*Assistant Examiner*—Christopher Harmon
(74) *Attorney, Agent, or Firm*—Klauber & Jackson

(57) ABSTRACT

The machine assembles cardboard boxes of the type that comprises a main piece or sheet and two independent sheets comprising the front ends, lateral sheets that attach to some laps that form part of the main piece. As a novel characteristic, it includes some side feeders where the independent lateral sheets are stacked and some devices for conveying such lateral sheets that place them on both sides of the male forming element or mandrel, in whose descent such lateral sheets are conveyed and also the main sheet to the folding mold located underneath where the box assembly will be finally formed. This folding mold also includes some improvements that facilitate the assembly of the box.

6 Claims, 8 Drawing Sheets

MACHINE FOR ASSEMBLING CARDBOARD BOXES

The present application is a Continuation of co-pending International Application No. PCT/ES02/00391, filed Aug. 2, 2002, under 35 USC §120.

OBJECT OF THE INVENTION

The invention consists of a machine for automatically assembling cardboard boxes, boxes essentially of those comprised of three pieces, two of which are applied laterally forming the front ends thereof on a main piece provided with laps that fold and fasten to said front ends.

The new machine considerably improves the assembling of this type of container that, on the other hand, proves to be relatively complex inasmuch as it is necessary to combine different cardboard parts in order to form the box assembly.

BACKGROUND OF THE INVENTION

There are different machines that fold cardboard boxes by means of an automatic continuous process.

Among these machines, one can point out those that automatically carry out the assembly of the type of boxes that include a main piece or sheet and two independent lateral sheets comprising the front ends that are attached to the main sheet or piece during the assembly process. These independent sheets are attached to some laps that form part of the main sheet or piece.

The current machines that assemble this type of box include different devices, that in general are very complex, mainly the devices which position the independent lateral sheets in the corresponding place of the box during assembly thereof.

This all has a negative effect on the assembly process, slowing same down, at the same time that sometimes the product obtained is not as good as expected.

DESCRIPTION OF THE INVENTION

In order to achieve the aims and in order to avoid the inconveniences mentioned in the preceding sections, the invention proposes a machine for assembling cardboard boxes.

The cardboard boxes are preferably of the type that is comprised of three sheet-like pieces, two of which comprise the front ends and a third main piece, where the front ends are fastened by means of an adhesive. Hence, the main sheet or piece comprises the bottom, the sides and some laps on which the other sheets or two pieces forming the front ends are attached with the help of adhesive, as mentioned above.

In principle the machine has a forming station wherein a mandrel or top male forming element descends vertically on a folding mold, where the main sheet or piece comprising the bottom, sides and small laps has been previously placed.

Besides, the machine includes a bottom folding mold opposite the mandrel or top male forming element, at the same time that it is arranged under the cited mandrel. It also includes a feeder of sheets or main pieces that move by some guides established on a horizontal plane located between the male forming element and the bottom mold.

First of all the machine is characterized in that the forming station has two side feeders located in a transversal arrangement with respect to the forward movement of the sheet or main piece. These feeders are the receivers of the lateral sheets forming the front ends of the boxes, in such a way that these lateral sheets are stacked vertically with a slight slant.

Another characteristic is the inclusion of the conveying means of such lateral sheets or front ends independent to the forming station, in a synchronized manner. Such means essentially consist of some devices whose purpose is to collect the independent sheets of the front ends from the side feeders in order to convey them to the forming station placing them precisely in the sides of the main sheet. In a subsequent step, the independent lateral sheets are inserted and therefore applied to the box when the mandrel or top male forming element moves vertically downward in order to carry out the assembly of the box, in such a way that in this descending operation of the mandrel and assembling of the box, said mandrel conveys the main sheet as well as the two independent lateral sheets in its vertical movement downward, the front ends or independent lateral sheets attaching to some laps integral with the bottom and sides of the main pieces by means of adhesive glue.

Each one of the lateral sheets or independent front ends conveying device comprises the following structure:

- Two tiltable arms that joint at one of their ends in respective shafts arranged in the same direction through a motor element.
- A cross shaft coupled freely in the free ends of the tiltable arms.
- At least one lever coupled jointedly by an end section in a shaft, a lever that acts as a guide and angular positioning to the cross shaft, because the cross shaft has a short extension fit in a guide rail of the lever.
- A suction pad support integral to the cross shaft, suction pads that are responsible for securing the lateral sheets by suction during the conveyance thereof.

All of this is in order to convey one by one by means of angular rotation of approximately 180° each lateral sheet of the front ends from the feeder to the forming station so that when the top male forming element descends, this male element simultaneously conveys the two lateral sheets of the front ends and the main sheet towards the matrix of the mold for folding the box.

Another characteristic of the machine is that the forming station includes some squares arranged vertically in correspondence with the vertical corners of the box to be formed, squares that are located in the arrival areas of the sheets or pieces of the front ends, at the same time that the squares have the task of prefolding some small side laps that are formed in the ends of said sheets of the front ends.

The squares essentially have a decreasing structure from top to bottom that favors the progressive forming of the side laps when the top male forming element acts when descending towards the matrix of the mold.

The machine also includes as a novel characteristic some pressure rotating rollers located in the sides of the top male forming element in correspondence with the mouth of the bottom folding mold. This is all so that when the top male forming element descends in order to form the box, the laps of the main sheet that originate in the bottom of the box collapse and are pushed against the lateral sheets of the front ends to favor their gluing.

The machine is also characterized in that the bottom folding or forming mold or matrix includes in its four corners some pairs of rotating rollers, some top ones with a cone-shaped structure and other bottom ones with a cylindrical structure. When the top male forming element descends for the forming of the box, the laps of the main sheets that originate in the ends of the sides collapse and are pushed towards the lateral sheets of the front ends in order to favor their gluing, the cone-shaped rollers facilitating the progressive folding of said laps of the sides of the box.

Finally, it should be pointed out that the folding mold includes as a novel characteristic some fingers with elastic retention, essentially by means of a spring, fingers that have the purpose of keeping some closing laps that originate in the free edges of the sides when the box has already been formed, folded. In this way, when the next box to be formed descends it does not fit inside the box already formed and in this way the latter is caused to descend.

Hereinafter to provide a better understanding of this specification and forming an integral part thereof, some figures in which the object of the invention has been represented in an illustrative and non-restrictive manner are attached hereto.

DESCRIPTION OF A PREFERRED EMBODIMENT

Figure 1:
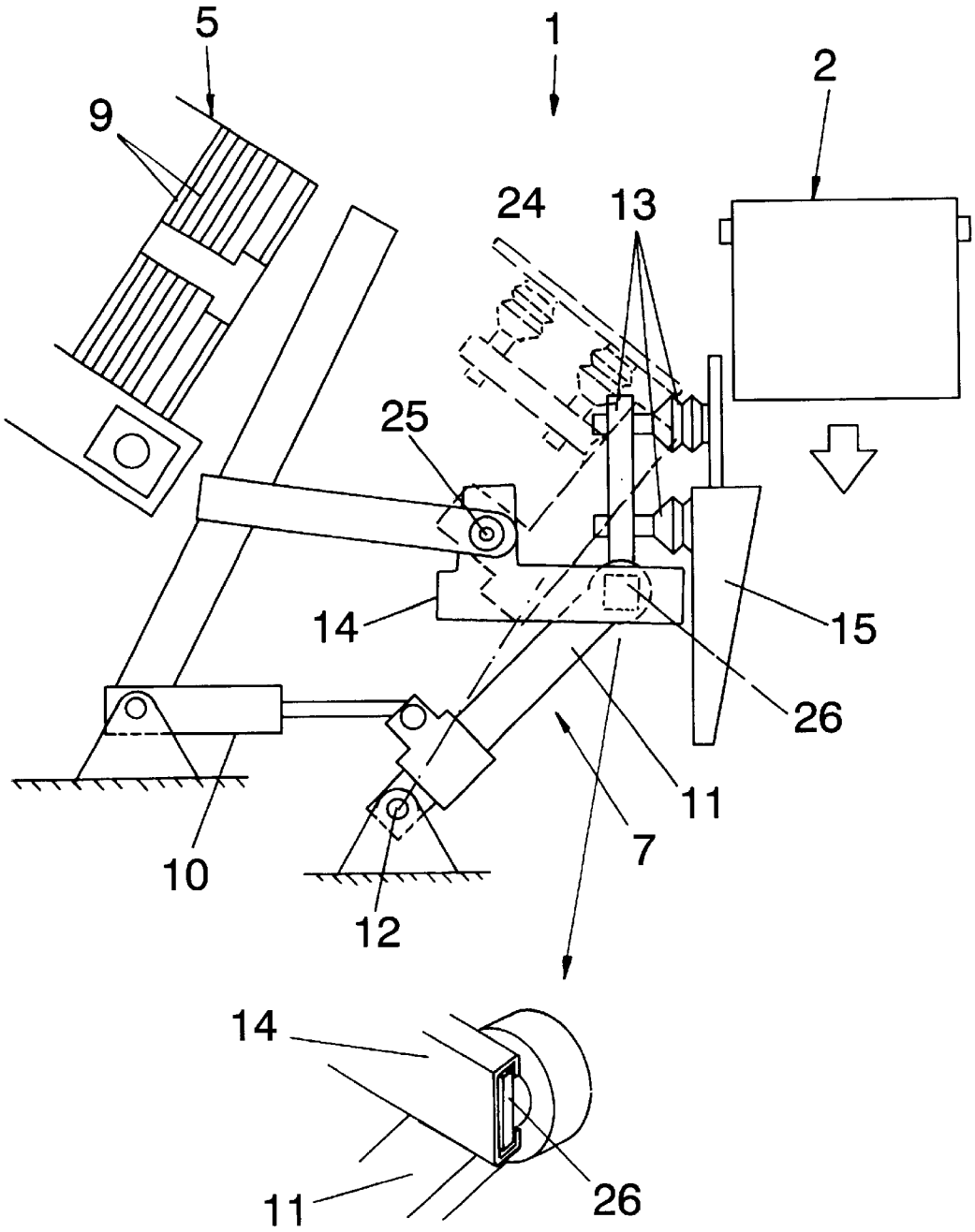
FIG. 1 shows a perspective view of one part of the machine for assembling cardboard boxes of the invention. A device for conveying some independent lateral sheets comprising the front ends of the boxes to be formed is essentially shown. One also sees a top male forming element established above the bottom folding mold.

An embodiment of the invention using the numbering in the figures is described hereinafter.

In principle the machine includes a forming station (1) wherein a mandrel or top male forming element (2) descends vertically on a folding mold (3), which a first piece or main cardboard sheet (4) has previously been placed on.

Up to here, it is a more or less common embodiment for this type of device.

The invention proposes providing this forming station (1) with some side feeders (5) and (6) located transversally to the forward movement of the main sheet (4), in such a way that synchronously and aided by respective transversal devices (7) and (8), the lateral sheets of the front ends (9) are supplied to the forming station (1), precisely placing the sheets in the sides of the main sheet (4) for the purpose of being inserted and therefore applied to the box or container when the male element or mandrel (2) carries out the descending vertical movement in order to assemble the box.

Figure 2:
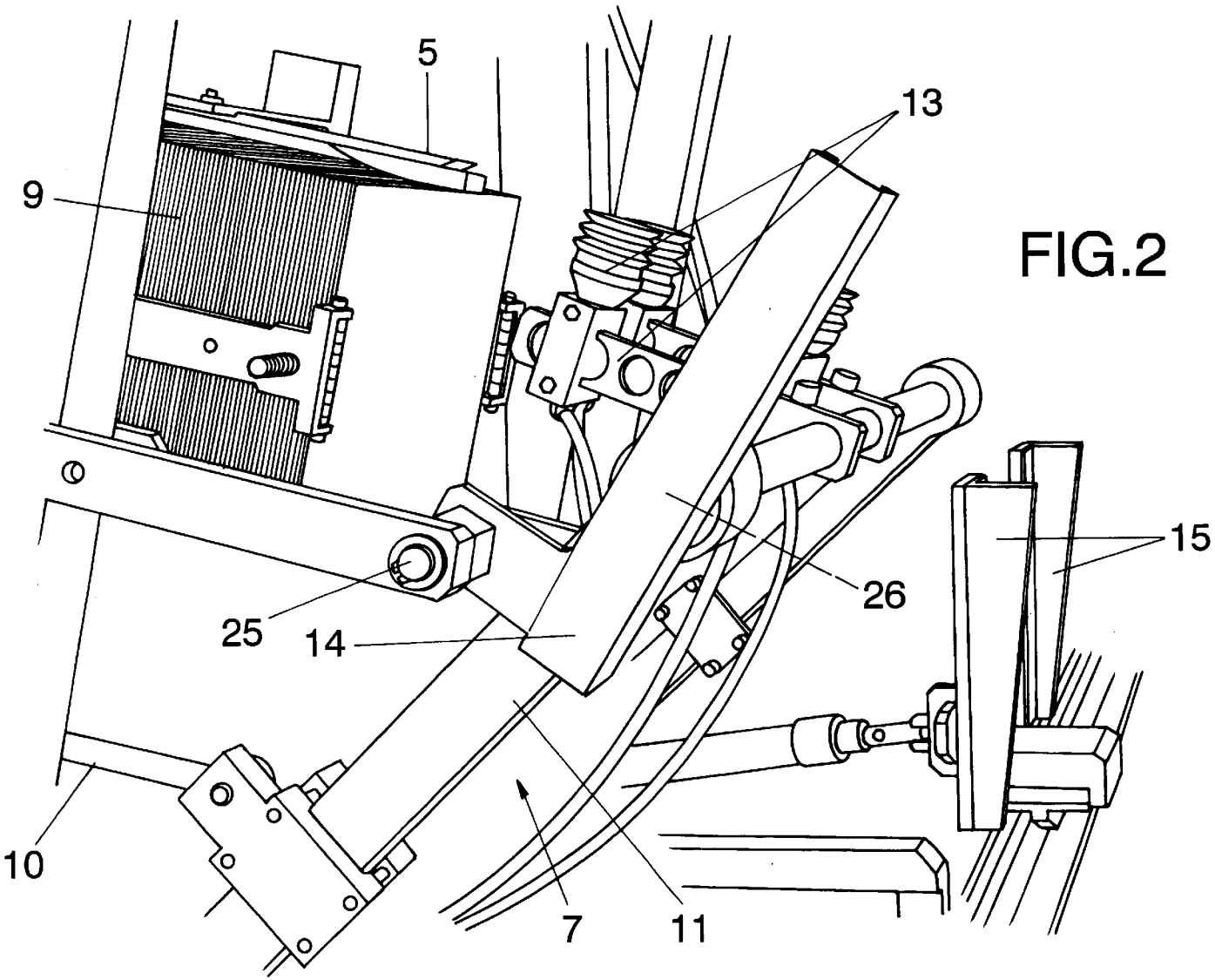
FIG. 2 shows a perspective view of the machine of the invention.
Figure 3:
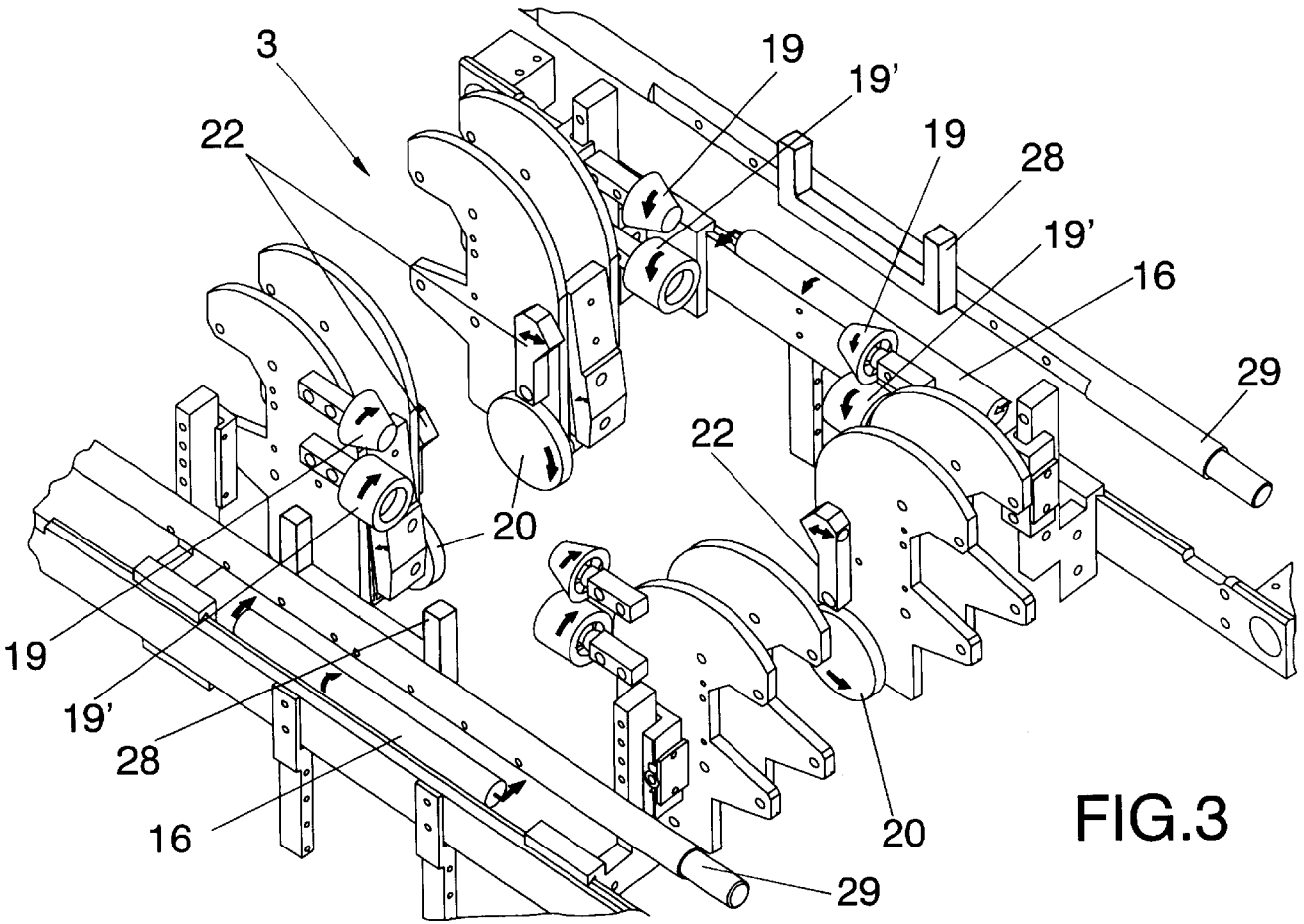
FIG. 3 shows a perspective view of a mandrel or top male forming element of the box, as well as the process of conveying the lateral sheets comprising the sides.

The following characteristic is the special configuration of the conveying devices (7) and (8) and that we see essentially represented in FIGS. 1 and 2.

As we see, the conveyance of the lateral sheet or front end (9) is accompanied by a rotation or overturning of the sheet approximately 180°, in such a way that which was the bottom side of the lateral sheet or front end in the feeders (5) and (6), when being applied on the forming station becomes the top side of the lateral sheet or front end once the box has been assembled.

The cause for this overturning is that not all the front end lateral sheets (9) are smooth nor do they have a uniform thickness. There are sheets where one area (normally the top once the box has been assembled) has a thickening or double wall, in such a way that the sheets should be placed in the feeders (5) and (6) with said thickening facing down in order to prevent an "accordion" effect caused by the combined thickness of all of the sheets (9).

Figure 4:
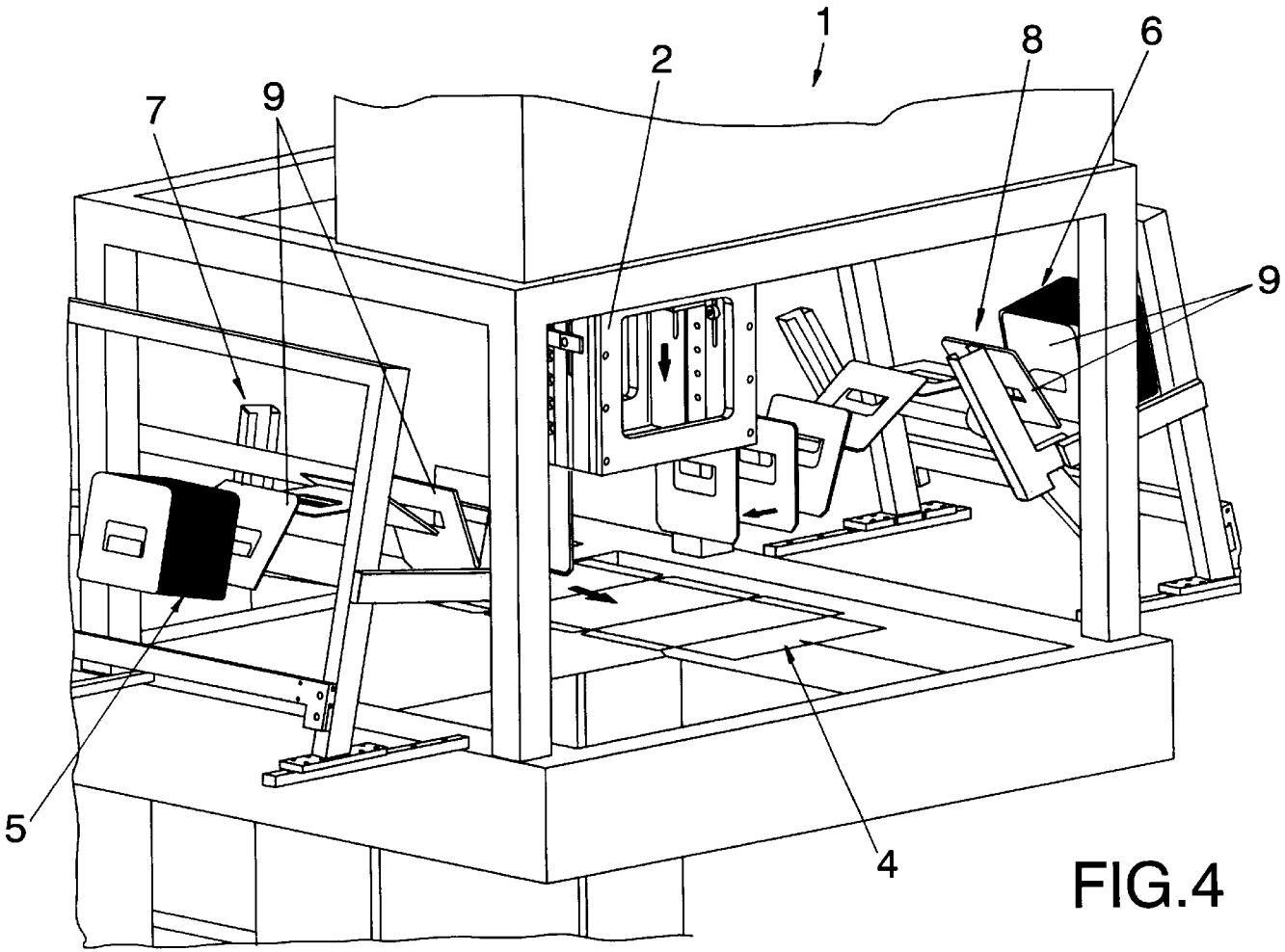
FIG. 4 shows a perspective view of the bottom folding mold assembly.

Hence, these lateral sheets (9) that are stacked in the feeders (5) and (6) with said reinforcement or thickness downward prevent said "accordion" effect, but it is necessary to rotate them 180° as more clearly shown in FIG. 4.

The structure that the conveying devices (7) and (8) have is essentially shown in FIGS. 1 and 2.

Hence, each one of the cited conveying devices comprises two tiltable arms (11) that joint by one of their ends in respective shafts (12) arranged in the same direction through a motor element (10); in such a way that in the free ends of said tiltable arms (11) a cross shaft (24) is freely coupled. The conveying devices also include at least one guide lever (14) jointedly coupled by an end section in a shaft (25); a lever (14) that acts as a guide and angular positioning of the cross shaft (24) since this cross shaft has a short extension (26) fit in a guide rail (27) of the lever (14). Said cross shaft has a suction pad (13) support integral to said shaft, suction pads (13) whose purpose is to secure the lateral sheets comprising the front ends (9) by suction during the conveyance thereof.

In this way, it is possible to convey one by one by means of an angular rotation of approximately 180° each lateral sheet of the front ends (9) from the feeder (5) and (6) up to the forming station (1) so that when the top male forming element (2) descends, this male element simultaneously conveys the two lateral sheets (9) of the front ends and the main sheet towards the matrix of the bottom forming mold (3) of the box.

Figure 5A:
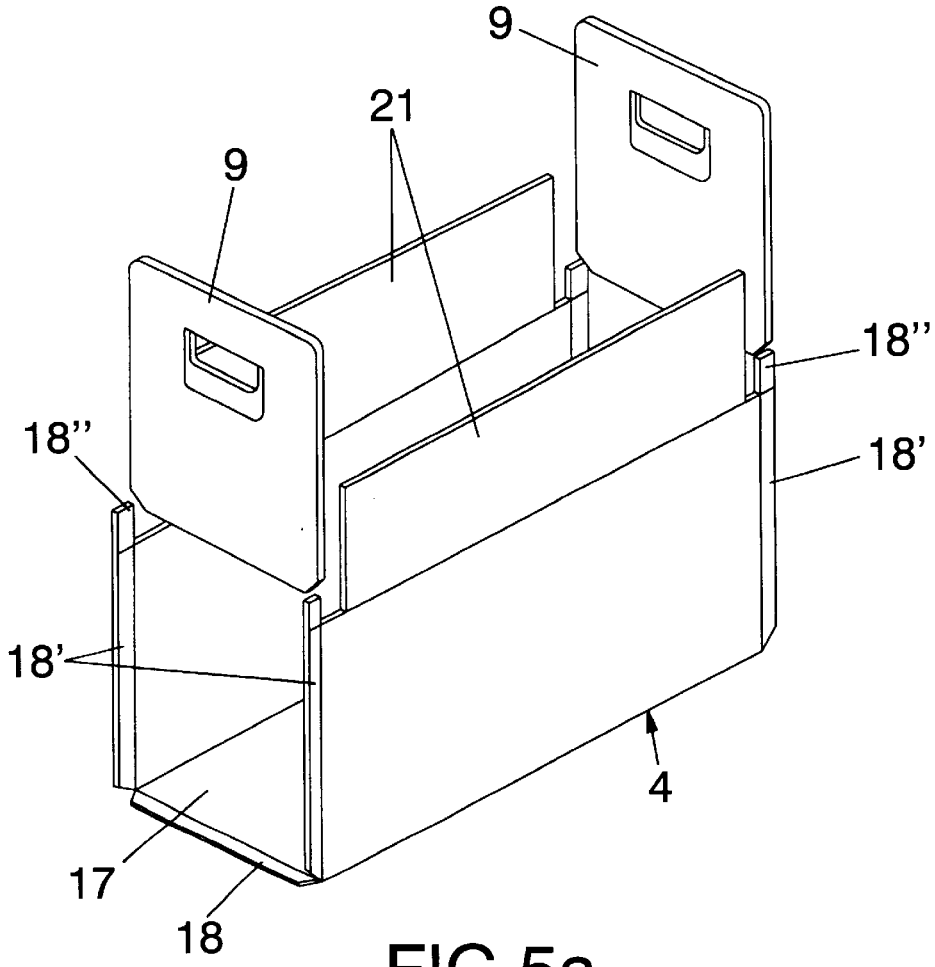
FIGS. 5*a* and 5*b* show some views of the boxes that are assembled with the machine of the invention.
Figure 6A:
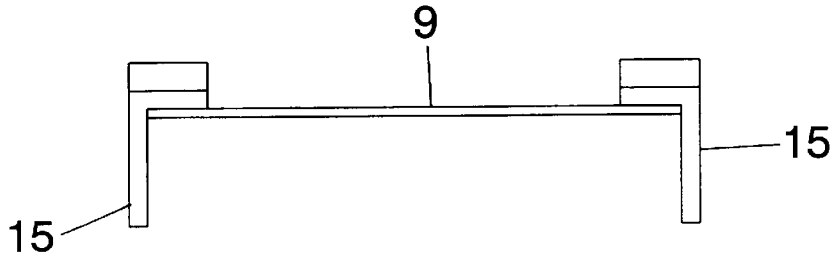
FIGS. 6*a* and 6*b* show some plan views where some side laps that form part of the independent lateral sheets comprising the front ends of the box to be assembled, are essentially shown.
Figure 5B:
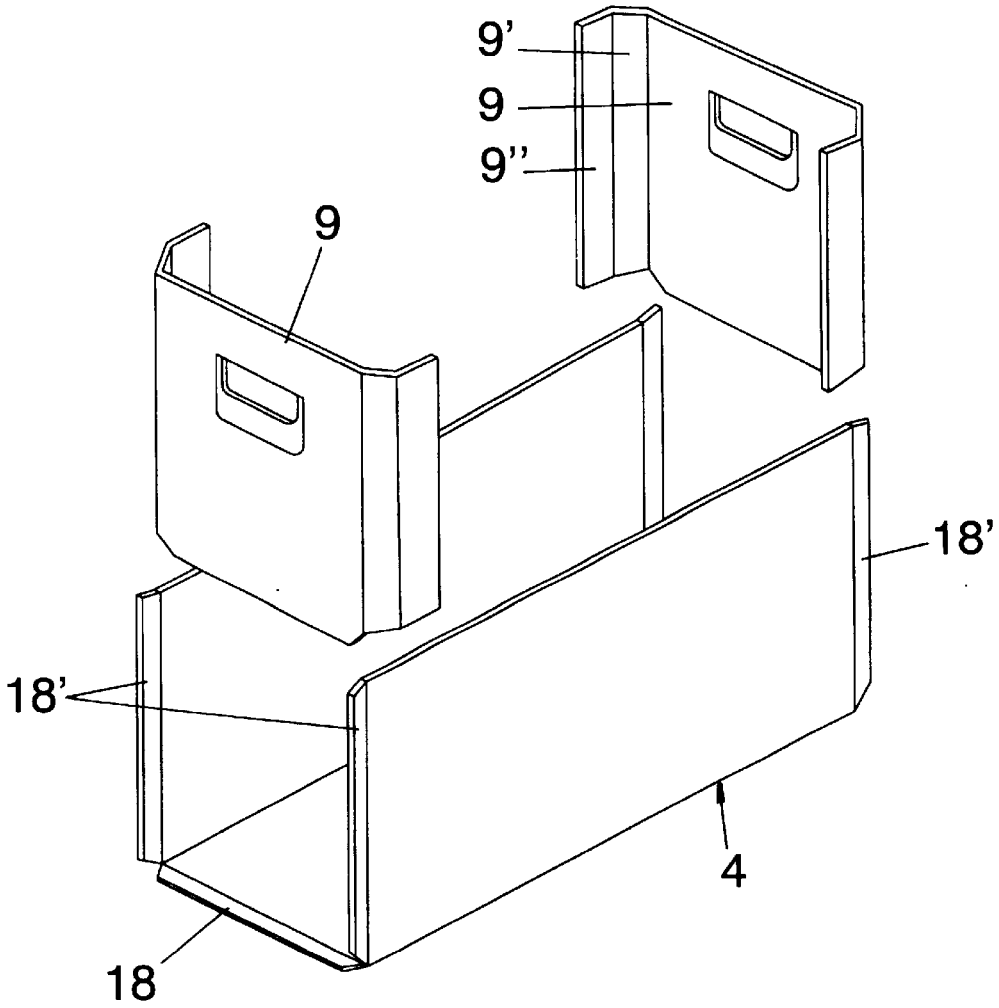
Figure 6B:
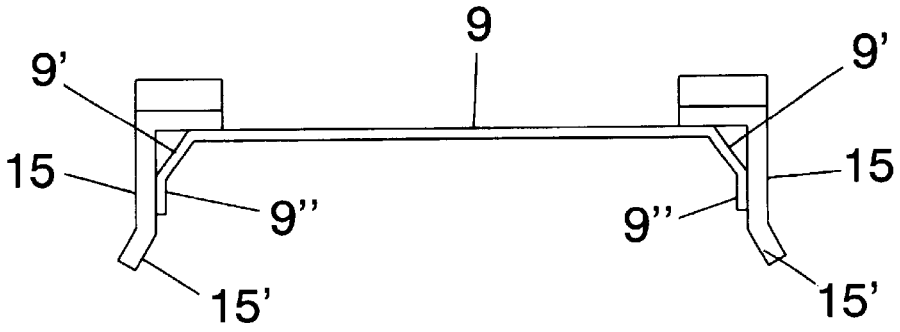

The forming station also includes (1) some squares (15) that are located in the arrival area of the lateral sheet (9) and have the purpose of prefolding some small lateral laps (9') that some type of front end may have, as shown more clearly in FIGS. 5*b* and 6*b*.

Besides, the lateral sheet (9) is capable of including other small end laps (9") that will abut against the inside surface of the sides. When these laps (9') and/or (9") are included, the squares (15) have an end elbow outward (15') that better facilitates the prefolding of said laps, which comprise some triangular reinforcement columns in the assembly.

The decreasing configuration of the cited squares favors the progressive forming when the top male forming element (2) operates.

On the other hand, the matrix or bottom folding mold assembly (3) also has novel characteristics that are specified hereinafter.

Hence, in the first place, it includes some pressure rollers (16) that push the laps (18) of the main sheet (4) against the lateral sheets of the front ends (9) in order to favor the progressive folding thereof first of all and then the total folding thereof. The main sheet (4) includes the bottom (17), two sides (23), the laps (18) emerging from the free edges of the bottom (17) and also other laps (18') that originate in the ends of the sides (23).

Hence, the forming station (1) includes some pressure rotating rollers (16) located in the sides of said forming station in correspondence with the mouth of the bottom forming module (3). In this way when the top male forming element (2) descends for the forming of the box, the laps (18) of the main sheet (4) that originate from the bottom of the box collapse and are pushed against the front end (9) lateral sheets in order to favor the gluing thereof.

Secondly, other pairs of rotating rollers are arranged in the four corners of the module, the upper ones being of conical structure (19) and the lower ones being of cylindrical structure (19'), all of this to facilitate the progressive gluing of the laps (18) of the main sheet (4). When the mandrel or top male forming element (2) for the forming of the box descends, the laps (18') of the main sheet (4) that originate from the ends of the sides collapse and they are pushed against the front end (9) lateral sheets in order to favor the gluing thereof, the conical structure rollers (19) facilitating the progressive gluing of said laps (18') of the sides of the box.

Figure 7:
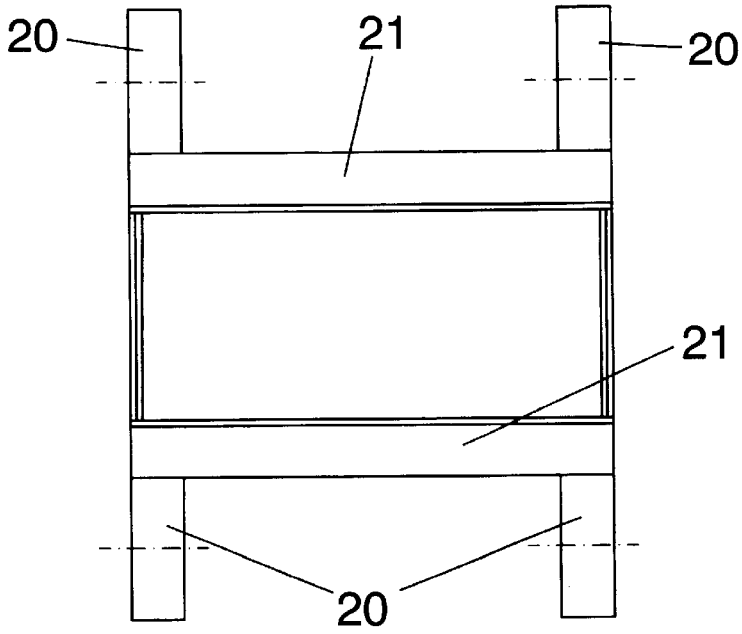
FIG. 7 shows a plan view of some rotating wheels or pulleys that stabilize the box already assembled inside. These wheels or pulleys are included in the bottom folding mold assembly.

Thirdly, four rotating pulleys (20) stabilize the box already assembled at its bottom part (FIG. 7), waiting for the formation of the following box to make the box descend towards the bottom outlet of the machine.

Figure 8:
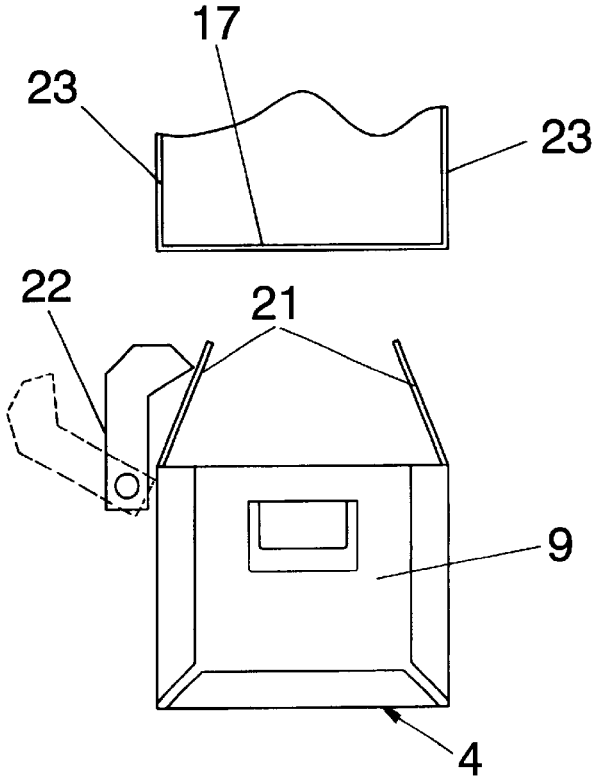
FIG. 8 shows a profile view of two boxes aligned vertically where some fingers whose purpose is to keep half folded some closing laps emerging from the free edges of the sides, are essentially shown. These fingers are also located in the bottom folding mold assembly.

Finally, in the preceding situation it is also convenient to have the closing laps (21) that originate from the free edges of the sides of the box already formed, slightly slanted towards the inside, so that when the next box descends it does not fit inside the already formed box and make it descend. For this purpose, four fingers (22) that are shown more clearly in FIG. 8 have been provided for.

The purpose of these fingers (22) is to keep the closing laps (21) that originate from the free edges of the sides folded when the box has been formed; all of this so that when the following box to be formed descends it does not fit inside the box already formed and make the latter descend.

Figure 9:
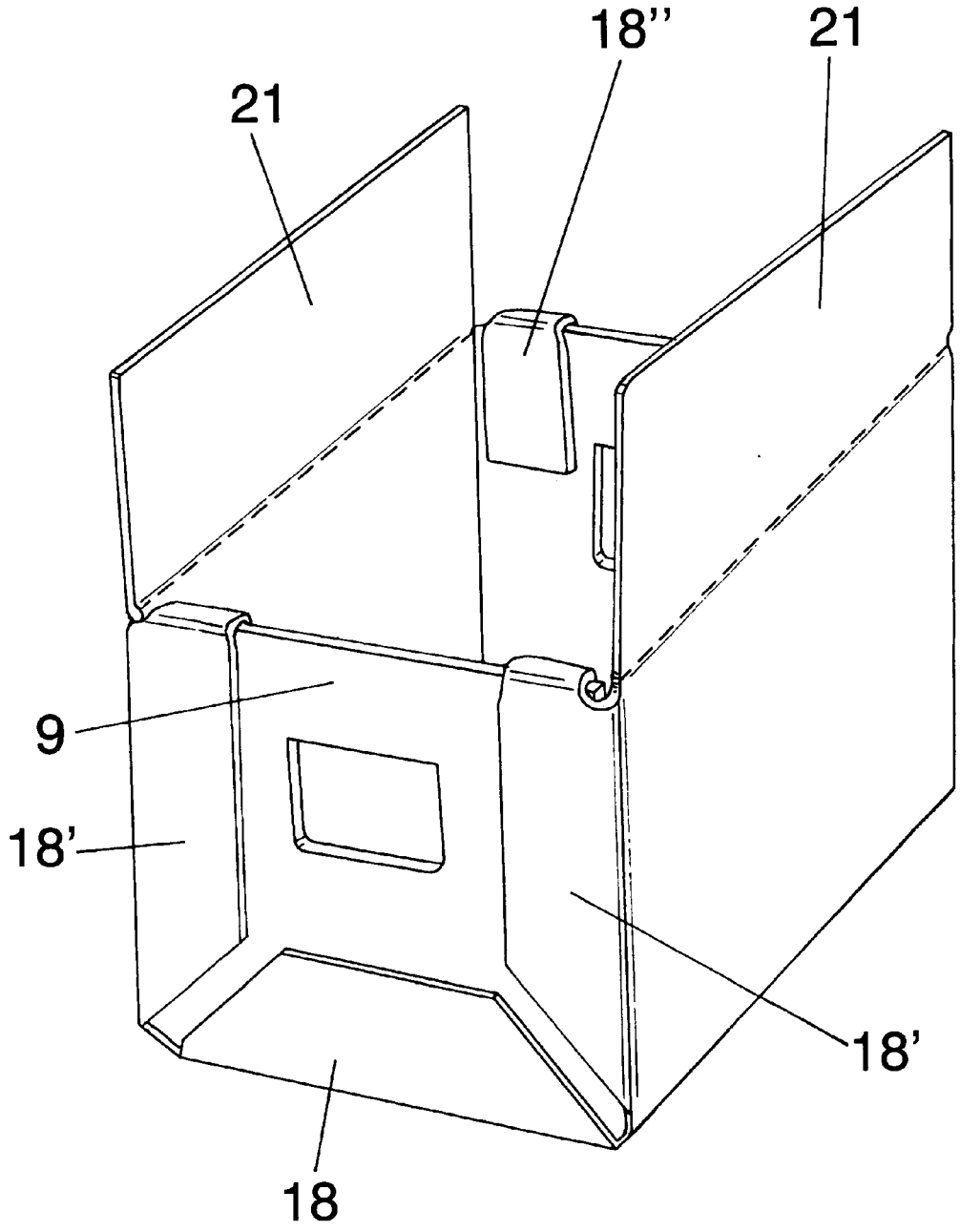
FIG. 9 shows a view of an assembled box obtained by means of the machine of the invention.

Referring to FIGS. 5*a*, 6*a* and 9, small extensions (18") that originate from the top edge of the laps (18') of the sides are shown therein, in such a way that in the assembly of the box, such extensions (18") collapse 180° towards the inside clasping at the top the front ends or lateral sheets (9). Hence, these are integral to the box in a more secure manner.

The collapsing of such extensions (18") is carried out by means of a rotating element (29), which a U-shaped piece (28) is united to, the branches of the U-shaped piece (28) carrying out the collapsing of such extensions (18").

What is claimed is:

1. A machine for assembling cardboard boxes, said boxes essentially comprising:

three sheets;

two lateral sheets for forming front ends of the boxes as independent elements;

a third main sheet including:

a bottom;

two sides;

bottom laps on the bottom;

side laps on the sides;

so that said laps be folded and fixed to said lateral sheets by adhesive means:

said machine comprising a structure for supporting at least:

a forming station for the boxes;

a top male forming element located in correspondence with the forming station;

a bottom folding mold having four corners, said bottom folding mold being arranged underneath the top male forming element and facing said top male forming element;

a feeder of the main sheets which are led by a plurality of guides established on a horizontal plane located between the top male forming element and the bottom folding mold;

two side feeders:

located in a transverse arrangement with respect to the guides of the main sheets;

for supporting the lateral sheets stacked in a vertical arrangement with a slight slant;

a plurality of conveying devices for supplying the lateral sheets to the forming station in a synchronized way:

collecting the lateral sheets from the respective side feeders;

transferring the lateral sheets to the forming station;

positioning the lateral sheets with precision in lateral positions of the main sheet for being introduced and applied to the box when the top male forming element is displaced according to a descending vertical movement so that the box be assembled;

wherein:

each of the conveying devices of the lateral sheets comprises:

a motor element;

two tiltable arms having a first end and a second end;

two shafts arranged in a same direction;

a cross shaft provided with a short extension at each end;

at least one guide lever having a first section and a second section provided with a guide rail;

at least one shaft;

a support for a plurality of suction pads;

where:

the two tiltable arms are hinged by the first end with the shafts, said swinging arms being moved by the motor element;

the cross shaft is freely coupled to the second end of the tiltable arms;

the guide lever is jointedly coupled fashion by the first section to the shaft;

the cross shaft is guided and angularly positioned by the short extension fitted in the guide rail of the guide lever;

the support for the suction pads for securing the lateral sheets by suction during the conveyance of said lateral sheets is integral with the cross shaft;

each lateral sheet is conveyed by means of an angular rotation of approximately 180° from the side feeder to the forming station so that the two lateral sheets and the main sheet be simultaneously pulled towards the bottom folding mold of the box when the top male forming element descends;

the bottom folding mold comprises pairs of rotating rollers comprising:

upper rollers of conical structure lower rollers of cylindrical structure;

so that when the top male forming element descends, the side laps be folded and pushed against the lateral sheets for favoring the side laps to be glued to the lateral sheets, the rollers of conical structure facilitating a progressive folding of said side laps;

the main sheet comprises a plurality of extensions;

the bottom folding mold comprises rotating elements provided with a U-shaped piece so that the extensions be folded.

2. A machine according to claim 1 wherein:

the lateral sheets are provided with lateral laps;

the forming station also comprises a plurality of squares: arranged vertically in correspondence with vertical corners of the box to be formed;

located in arrival areas of the lateral sheets, so that the lateral laps be pre-folded.

3. A machine according to claim 2, wherein the squares have a decreasing structure from top to bottom so that a progressive shaping of the lateral laps be favored when the top male forming element is displaced downwards the bottom folding mold.

4. A machine according to claim 1, wherein the machine further comprises a plurality of pressure rotating rollers located on sides of the forming station, in correspondence with a mouth in the bottom folding mold, so that the bottom laps be folded and pushed against the lateral sheets to favor the bottom laps be glued to the lateral sheets when the top male forming element is displaced according to a descending vertical movement.

5. A machine according to claim 1, wherein the bottom folding mold comprises four lower rotating pulleys for stabilizing the already assembled box at the lower part of said box, said lower rotating pulleys making contact on a part of the sides of said box, so that formation of a next box causes the already assembled box to descend towards a lower exit of the machine.

6. A machine according to claim 1, wherein the bottom folding mold comprises four fingers with elastic retention, essentially by means of a spring, for ensuring that closing laps arising from free edges of the sides, remain folded once the box has been formed, so as to avoid the next box to be shaped be fitted when descending into the inside of the box already formed but cause said formed box to descend.

* * * * *